US006221550B1

(12) United States Patent
Wilson et al.

(10) Patent No.: US 6,221,550 B1
(45) Date of Patent: Apr. 24, 2001

(54) 4H-PYRAN CHARGE CONTROL AGENTS FOR ELECTROSTATOGRAPHIC TONERS AND DEVELOPERS

(75) Inventors: John Charles Wilson; Gretchen Schmidt McGrath; Satyanarayan Ayangar Srinivasan, all of Rochester, NY (US)

(73) Assignee: NexPress Solutions LLC, Rochester, NY (US)

( * ) Notice: Subject to any disclaimer, the term of this patent is extended or adjusted under 35 U.S.C. 154(b) by 0 days.

(21) Appl. No.: 09/540,788

(22) Filed: Mar. 31, 2000

(51) Int. Cl.[7] ..... G03G 9/097
(52) U.S. Cl. ..... 430/110
(58) Field of Search ..... 430/110, 106

(56) References Cited

U.S. PATENT DOCUMENTS

| | | | | |
|---|---|---|---|---|
| 4,598,033 | * | 7/1986 | Kawamura et al. | 430/76 |
| 5,405,727 | | 4/1995 | Wilson et al. | 430/110 |
| 5,760,073 | | 6/1998 | Urbahns et al. | 514/451 |

* cited by examiner

*Primary Examiner*—John Goodrow
(74) *Attorney, Agent, or Firm*—Lawrence P. Kessler

(57) ABSTRACT

An electrostatographic toner composition comprises a polymeric binder and a charge control agent selected from the group consisting of 4H-pyrans having the following general structure:

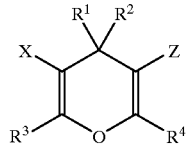

where $R^1$ and $R^2$ are the same or different, each representing H or an alkyl, an aryl or a heterocyclic group, or $R^1$ and $R^2$ taken together may form a saturated hydrocarbon ring;

$R^3$ and $R^4$ each represent an alkyl or an aryl group;

X and Z are the same or different, each representing a cyano substituent, or an alkanoyl, an aroyl, an alkoxycarbonyl, an aryloxycarbonyl, an arylaminocarbonyl, or an alkylaminocarbonyl group.

An electrostatographic developer comprises particles of the described toner composition together with carrier particles.

27 Claims, No Drawings

4H-PYRAN CHARGE CONTROL AGENTS FOR ELECTROSTATOGRAPHIC TONERS AND DEVELOPERS

FIELD OF THE INVENTION

The present invention relates to electrographic materials and, more particularly, to electrostatographic toners and developers that comprise 4H-pyran compounds as charge control agents.

BACKGROUND OF THE INVENTION

In electrography, image charge patterns are formed on a support and are developed by treatment with an electrographic developer containing marking particles which are attracted to the charge patterns. These particles are called toner particles or, collectively, toner. Two major types of developers, dry and liquid, are employed in the development of the charge patterns.

In electrostatography, the image charge pattern, also referred to as an electrostatic latent image, is formed on an insulative surface of an electrostatographic element by any of a variety of methods. For example, the electrostatic latent image may be formed electrophotographically, by imagewise photoinduced dissipation of the strength of portions of an electrostatic field of uniform strength previously formed on the surface of an electrophotographic element comprising a photoconductive layer and an electrically conductive substrate. Alternatively, the electrostatic latent image may be formed by direct electrical formation of an electrostatic field pattern on a surface of a dielectric material.

One well-known type of electrostatographic developer comprises a dry mixture of toner particles and carrier particles. Developers of this type are employed in cascade and magnetic brush electrostatographic development processes. The toner particles and carrier particles differ triboelectrically such that, during mixing to form the developer, the toner particles acquire a charge of one polarity and the carrier particles acquire a charge of the opposite polarity. The opposite charges cause the toner particles to cling to the carrier particles. During development, the electrostatic forces of the latent image, sometimes in combination with an additional applied field, attract the toner particles. The toner particles are pulled away from the carrier particles and become electrostatically attached, in imagewise relation, to the latent image bearing surface. The resultant toner image can then be fixed, by application of heat or other known methods, depending upon the nature of the toner image and the surface, or can be transferred to another surface and then fixed.

Toner particles often include charge control agents, which, desirably, provide uniform net electrical charge to toner particles without reducing the adhesion of the toner to paper or other medium. Positive charge control agents impart a positive charge to toner particles in a developer; negative charge control agents impart a negative charge to the toner particles relative to the carrier particles.

U.S. Pat. No. 5,405,727, whose disclosure is incorporated herein by reference, describes N-(carbonyl, carbonimidoyl, and carbonothioyl) sulfonamide compounds as negative charge control agents in electrophotographic toners. Other types of negative charge control agents are described in U.S. Pat. Nos. 4,464,452; 4,480,021; and 5,186,736, the disclosures of which are incorporated herein by reference.

Many prior art negative charge control agents have a variety of shortcomings. For example, some are dark colored and cannot be readily used with pigmented toners such as cyan, magenta, yellow, red, blue, and green toner particles. In addition, some previously known charge control agents are highly toxic or produce highly toxic by-products, while others are highly sensitive to environmental conditions such as humidity. Still others exhibit high throw-off or adverse triboelectric properties under certain conditions of use. There is thus a continuing need for negative charge control agents having improved properties relative to those currently known in the art.

A general route leading to the formation of 4H-pyrans via the zinc chloride catalyzed condensation of β-dicarbonyl compounds with aldehydes is described in J. Wolinsky and H. S. Hauer, *J. Org. Chem,* 1969, Vol. 34, No.10, page 3169. U.S. Pat. No. 5,760,073 describes the synthesis of substituted 4H-pyrans for use as active compounds in medicaments, in particular, for the treatment of the central nervous system. Their use in the field of electrostatographics, however, has until now been unknown.

SUMMARY OF THE INVENTION

The present invention is directed to an electrostatographic toner composition that comprises a thermoplastic polymeric binder and a charge control agent selected from the group consisting of 4H-pyran compounds represented by the following general structure:

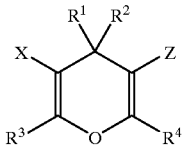

where $R^1$ and $R^2$ are the same or different, each representing H or an alkyl, an aryl or a heterocyclic group, or $R^1$ and $R^2$ taken together may form a saturated hydrocarbon ring;

$R^3$ and $R^4$ each represent an alkyl or an aryl group;

X and Z are the same or different, each representing a cyano substituent, or an alkanoyl, an aroyl, an alkoxycarbonyl, an aryloxycarbonyl, an arylaminocarbonyl, or an alkylaminocarbonyl group.

The present invention is further directed to an electrostatographic developer that comprises particles of the above described toner composition together with carrier particles.

DETAILED DESCRIPTION OF THE INVENTION

In preferred embodiments of the present invention, $R^1$ represents H or a phenyl group, including 4-chlorophenyl, 4-methylphenyl, 4-ethylphenyl, 4-methoxyphenyl, and

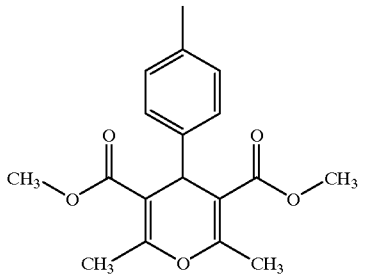

$R^2$ preferably represents H, and $R^3$ and $R^4$ preferably each represents an alkyl group containing up to about 8 carbon atoms, more preferably, a methyl substituent. Preferably, X and Z each represent an alkoxycarbonyl, alkanoyl, or arylaminocarbonyl group, more preferably, an ethoxycarbonyl, a methoxycarbonyl, an acetyl, or a phenylaminocarbonyl substituent.

Unless otherwise specifically stated, the terms "substituted" or "substituent" are used to refer to any group or atom other than hydrogen. Additionally, the term "group", when used to refer to a substituent that includes a substitutable hydrogen, encompasses not only the substituent's unsubstituted form but also its form further substituted with any substituent or group that does not interfere with the charge control function of the pyran compound.

The term "particle size" used herein, or the term "size", or "sized" as employed herein in reference to the term "particles", means the median volume weighted diameter as measured by conventional diameter measuring devices, such as a Coulter Multisizer, sold by Coulter, Inc., Hialeah Fla. Median volume weighted diameter is the diameter of an equivalent weight spherical particle that represents the median for a sample, i.e., half of the mass of the sample is composed of smaller particles, and half of the mass of the sample is composed of larger particles than the median volume weighted diameter.

The term "charge control" refers to a propensity of a toner addendum to modify the triboelectric charging properties of the resulting toner.

The term "glass transition temperature" or "Tg" as used herein means the temperature at which a polymer changes from a glassy state to a rubbery state. This temperature (Tg) can be measured by differential thermal analysis as disclosed in "Techniques and Methods of Polymer Evaluation", Vol. 1, Marcel Dekker, Inc., New York, 1966.

The toner of the present invention includes a charge control agent of the invention in an amount effective to modify and preferably improve the properties of the toner. It is preferred that a charge control agent improve the charging characteristics of a toner, so that the toner quickly charges to a negative value that is then substantially maintained.

It is also preferred that a charge control agent improve the charge uniformity of a toner composition to ensure that substantially all of the individual toner particles exhibit a triboelectric charge of the same sign with respect to a given carrier. It is further preferred that "toner throw-off", the amount of toner powder thrown out of a developer mix as it is mechanically agitated, for example, within a development apparatus, be minimized. Toner throw-off can cause unwanted background development and general contamination problems.

The triboelectric charge of electrophotographic developers changes with life. This instability in charging level is one of the factors that require active process control systems in electrophotographic printers to maintain consistent print to print image-density. It is desirable to have low charge/mass (Q/m) developers that are stable with life. The low Q/m has the advantage of improved electrostatic transfer and higher density capabilities. Furthermore, the trend towards decreasing particle size of toners results in cohesive toners with poor flow properties. As a result, toners typically require silica surface treatment for achieving the desirable level of flow. Surface treatment with silica results in vastly increased charge levels relative to the untreated toner. Thus, it is desirable to lower the charge to mass ratio (Q/m) of the untreated toner so as to accommodate the increased charge due to silica surface treatment.

The lower Q/m offers advantages of improved transfer and higher image densities. However, low Q/m is often achieved at a severe penalty in the throw-off amounts, which is undesirable as it results in a dusty developer. Low throw-off values (less than 20 mg of dust per added fresh toner) combined with low Q/m (less than 50 $\mu$C/g) is desirable because lower charge can be attained without an accompanying penalty of higher dust.

In a printer, fresh replenishment toner is typically added continuously to aged developer in the station. It is desirable that the fresh replenishment toner rapidly charge up against the carrier so as to limit the amount of toner dust. Toner dust results from toners with low Q/m and is typically severe in the case of slower charging toners.

It is further preferred that a charge control agent be substantially colorless, particularly for use in light colored toners. The charge control agents of the present invention are substantially colorless. It is also preferred that a charge control agent be metal free and have good thermal stability. The charge control agents of the present invention are metal free and have good thermal stability. Preferred materials described herein are based upon an evaluation in terms of a combination of characteristics rather than any single characteristic.

The properties of the thermoplastic polymers employed as the toner matrix phase in the present invention can vary widely. Amorphous toner polymers having a glass transition temperature in the range of about 50° C. to about 120° C., or blends of substantially amorphous polymers with substantially crystalline polymers having a melting temperature in the range of about 65° C. to about 200° C. can be utilized in the present invention. Preferably, the thermoplastic polymers used in the practice of this invention are substantially amorphous. Polymers useful as binders in the toner of the invention include, for example, styrene/acrylic copolymers and polyesters.

An optional but preferred component of the toner of the invention is a colorant such as a pigment or dye. Suitable dyes and pigments are disclosed, for example, in U.S. Reissue Pat. No. 31,072 and in U.S. Pat. Nos. 4,160,644; 4,416,965; 4,414,152; and 2,229,513, the disclosures of which are incorporated herein by reference. One particularly useful colorant for toners to be used in black and white electrostatographic copying machines and printers is carbon black. Colorants are generally employed in the range of from about 1 to about 30 weight percent on a total toner powder weight basis, preferably in the range of about 2 to about 15 weight percent.

The toner of the invention can also contain other additives of the type used in previous toners, including leveling agents, surfactants, stabilizers, and the like. The total quantity of such additives can vary. A present preference is to employ not more than about 10 weight percent of such additives on a total toner powder composition weight basis.

The charge control agent (CCA) is incorporated into the toner at a concentration preferably of about 0.5–10 parts per hundred parts of polymeric binder, more preferably, at about 1–5 parts CCA per hundred parts of binder. In a dry electrostatographic toner, for example, the charge control agent of the invention can be mixed in any convenient manner, such as blending with an appropriate polymeric binder material and any other desired addenda, as described, for example, in U.S. Pat. Nos. 4,684,596 and 4,394,430, the disclosures of which are incorporated herein by reference. The mixture is then ground to desired particle size to form a free-flowing powder of toner particles containing the charge agent.

A preformed mechanical blend of particulate polymer particles, charge control agent, colorants and additives can, alternatively, be roll milled or extruded at a temperature sufficient to melt blend the polymer or mixture of polymers to achieve a uniformly blended composition. The resulting material, after cooling, can be ground and classified, if desired, to achieve a desired toner powder size and size distribution. For a polymer having a $T_g$ in the range of about 50° C. to about 120° C., or a $T_m$ in the range of about 65° C. to about 200° C., a melt blending temperature in the range of about 90° C. to about 240° C. is suitable using a roll mill or extruder. Melt blending times, that is, the exposure period for melt blending at elevated temperature, are in the range of about 1 to about 60 minutes. After melt blending and cooling, the composition can be stored before being ground. Grinding can be carried out by any convenient procedure. For example, the solid composition can be crushed and then ground using a fluid energy or jet mill, as described in U.S. Pat. No. 4,089,472, the disclosure of which is incorporated herein by reference. Classification can be accomplished using one or two steps.

In place of melt blending or the like, the polymer can be dissolved in a solvent in which the charge control agent and other additives are also dissolved or are dispersed. The resulting solution can be spray dried to produce particulate toner powders. Limited coalescence polymer suspension procedures, as disclosed in U.S. Pat. No. 4,833,060, whose disclosure is incorporated herein by reference, are particularly useful for producing small sized, uniform toner particles.

The toner particles can have an average diameter between about 0.1 $\mu$m and about 100 $\mu$m, and preferably have an average diameter in the range of from about 4 $\mu$m to about 30 $\mu$m.

Two-component developers of the present invention include a carrier and a toner. Carriers can be conductive, non-conductive, magnetic, or non-magnetic. Carriers are particulate and can be, for example: glass beads; crystals of inorganic salts such as aluminum potassium chloride, ammonium chloride, or sodium nitrate; granules of zirconia, silicon, or silica; particles of hard resin such as poly(methyl methacrylate); particles of elemental metal or alloy or oxide such as iron, steel, nickel, carborundum, cobalt, oxidized iron, and mixtures of such materials. Examples of carriers are disclosed in U.S. Pat. Nos. 3,850,663 and 3,970,571, the disclosures of which are incorporated herein by reference. Especially useful in magnetic brush development procedures are iron particles such as porous iron, particles having oxidized surfaces, steel particles, and other "hard" and "soft" ferromagnetic materials such as gamma ferric oxides or ferrites of barium, strontium, lead, magnesium, or aluminum. Such carriers are described in U.S. Pat. Nos. 4,042,518; 4,478,925; and 4,546,060, the disclosures of which are incorporated herein by reference.

Carrier particles can be uncoated, or they can be coated with a thin layer of a film-forming resin to establish the correct triboelectric relationship and charge level with the toner employed. Examples of suitable resins are the polymers described in U.S. Pat. Nos. 3,547,822; 3,632,512; 3,795,618 and 3,898,170 and Belgian Patent No.797,132, the disclosures of which are incorporated herein by reference. Other useful resins are fluorocarbons such as polytetrafluoroethylene, poly(vinylidene fluoride), mixtures of these, and copolymers of vinylidene fluoride and tetrafluoroethylene; see, for example, U.S. Pat. Nos. 4,545,060; 4,478,925; 4,076,857; and 3,970,571, whose disclosures are incorporated herein by reference.

In preferred developers of the present invention, the carrier comprises strontium ferrite particles, which can be coated with poly(methyl methacrylate), polysiloxane, or dehydrofluorinated and oxidized fluorocarbon.

In a particular embodiment, the developer of the invention contains from about 1 to about 20 percent by weight of toner of the invention and from about 80 to about 99 percent by weight of carrier particles. Usually, carrier particles are larger than toner particles. Conventional carrier particles have a particle size of from about 5 to about 1200 $\mu$m and are generally from 20 to 200 $\mu$m.

The toners of the present invention are not limited to developers that include both carrier and toner but can be used, without carrier, as a single component developer. The toners and developers of the invention can be used in a variety of ways to develop electrostatic charge patterns or latent images. Such developable charge patterns can be prepared by a number of methods and are then carried by a suitable element. The charge pattern can be carried, for example, on a light sensitive photoconductive element or a non-light-sensitive dielectric surface element, such as an insulator coated conductive sheet. One suitable development technique involves cascading developer across the electrostatic charge pattern. Another technique involves applying toner particles from a magnetic brush. This technique involves the use of magnetically attractable carrier cores. After imagewise deposition of the toner particles, the image can be fixed, for example, by heating the toner to cause it to fuse to the substrate carrying the toner. If desired, the unfused image can be transferred to a receiver such as a blank sheet of copy paper and then fused to form a permanent image.

4H-Pyrans were synthesized by the zinc chloride catalyzed reaction of benzaldehydes with β-dicarbonyl compounds in acetic anhydride, as described in the previously mentioned U.S. Pat. No. 5,760,073:

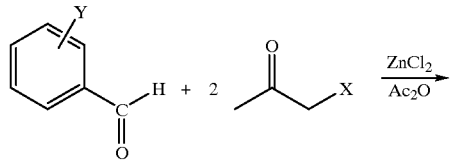

-continued

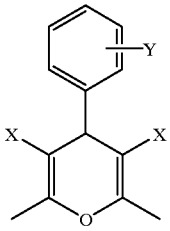

where Y is preferably H, a halo substituent, an alkyl group, or an alkoxy group, more preferably, H or a chloro, methyl, ethyl, or methoxy substituent.

A bis(4H-pyran) was synthesized by a similar method from terephthalaldehyde and methyl acetoacetate, as shown by the following reaction scheme:

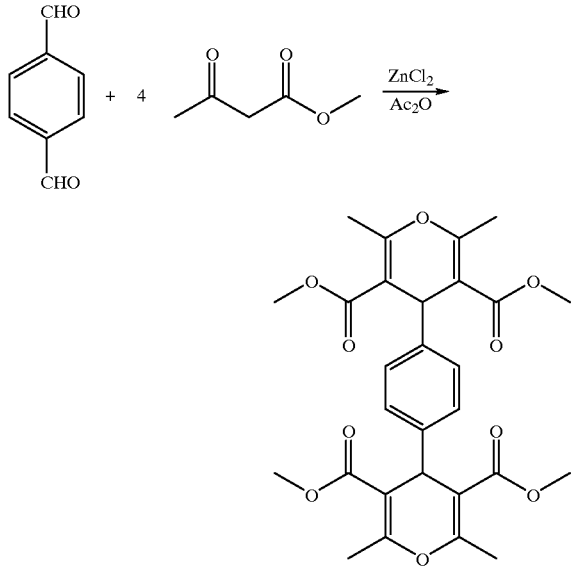

In addition to aryl aldehydes depicted as starting materials in the above reaction schemes, aliphatic aldehydes, heterocyclic aldehydes, ketones, or formaldehyde are useful starting materials in the preparation of the 4H-pyran compounds of the present invention. Additional β-dicarbonyl compounds useful in the preparation of the 4H-pyrans of the present invention include but are not limited to other alkyl or aryl β-ketoesters, alkyl or aryl-β-diketones, and N-aryl or N-alkyl β-ketoamides.

4H-Pyrans where X and Z differ from one another and/or where $R^3$ and $R^4$ differ from one another also fall within the scope of the invention and can be prepared by the reaction of ylidene compounds with β-dicarbonyl compounds. For example, the ylidene formed by the reaction of benzaldehyde with acetylacetanilide can be reacted with methyl propionyl acetate to give an unsymmetrical 4H-pyran:

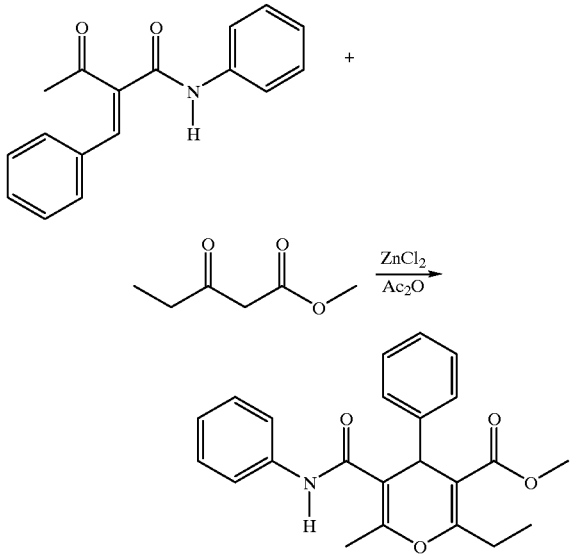

Table I lists structures and properties of illustrative examples of 4H-pyran compounds useful as charge control agents in accordance with the present invention. Typically, the compounds are substantially colorless or are only slightly colored and can thus be usefully included in colored toners, for example, cyan, magenta, and yellow, in addition to black toners.

In Table I, all reported melting points are uncorrected. The pyran compounds were synthesized according to procedures previously described in J. Wolinsky and H. S. Hauer in *J. Org. Chem.,* 1969, Vol. 34, No. 10, page 3169; and K. Urbahns, et al., U.S. Pat. No. 5,760,073, the disclosures of which are incorporated herein by reference. Unless otherwise indicated, all other chemicals were commercially available. NMR spectra were obtained with a GE QE-300 NMR spectrometer. Spectra agreed with proposed structures and are not reported here. Thermogravimetric analyses (TGA) were measured with a Perkin-Elmer Series 7 Thermal Analysis system at a heating rate of 10° C./min in air from 25–500° C. TGA values represent the onset of thermal degradation.

Preparation of 4-Phenyl-3,5-bis(carbomethoxy)-2,6-dimethyl-4H-pyran

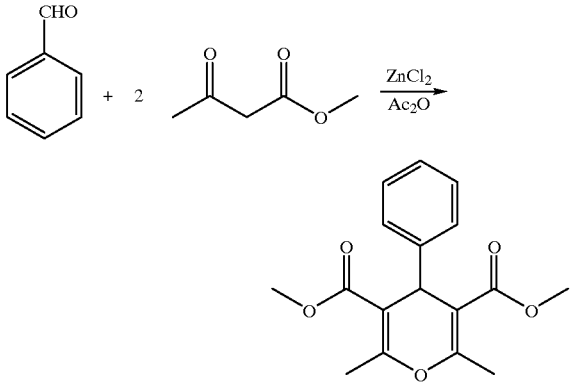

To a mixture of 19.2 ml of acetic anhydride and 13.6 g (100 mmol) of zinc chloride was added 27.9 g (240 mmol)

of methyl acetoacetate and 10.61 g (100 mmol) of benzaldehyde. The exothermic mixture was stirred and heated in a 63° C. bath for 16.67 hr, cooled, diluted with methylene chloride, washed twice with water, dried over magnesium sulfate, and concentrated to a viscous oil. The oil was extracted three times with P-950 ligroine, and the combined extracts were concentrated. The residue crystallized and was redissolved in 10:1 toluene:EtOAc mixture, and the solution was passed through a silica gel column. The resultant solution was concentrated, and the residue was dissolved in hot heptane. The yellow crystals that separated on cooling were collected and dried to give 15.23 g of product (50.37% of theory); m.p. 62.5° C. (DSC). Anal.: Calcd. for $C_{17}H_{18}O_5$: C, 67.5; H, 6.0. Found: C, 67.67; H, 6.03.

Preparation of 4,4'-Phenylenebis[3,5-bis (carbomethoxy)-2,6-dimethyl-4H-pyran-4-yl]

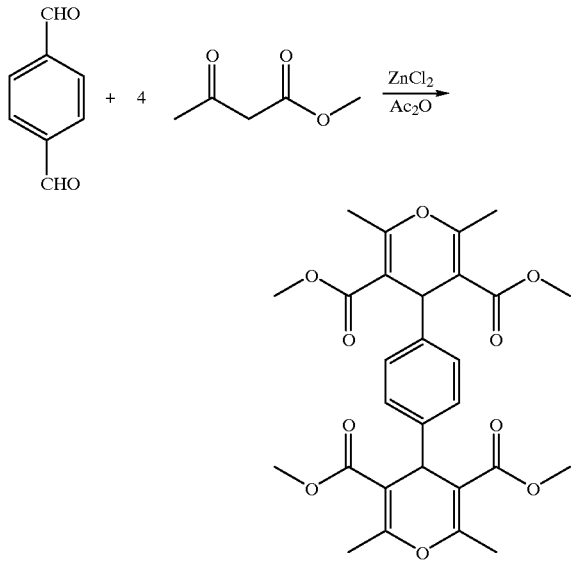

To a mixture of 19.2 ml of acetic anhydride and 13.6 g (100 mmol) of zinc chloride was added 27.9 g (240 mmol) of methyl acetoacetate and 6.71 g (50 mmol) of terephthalaldehyde. The mixture was stirred in a 60° C. bath under nitrogen for 17.5 hr, then cooled. To the resultant solution was added to 870 ml of water. The water was removed by decantation, and fresh water was added to the gummy solid. The water was again removed, and the gummy solid was dissolved in methylene chloride. The solution was washed with water, dried over magnesium sulfate, and concentrated. The residue was slurried in hot methanol, collected and dried. The yield of product was 9.30 g (35.33%); m.p. 197–9° C. Anal.: Calcd. for $C_{28}H_{30}O_{10}$: C, 63.9; H, 5.7. Found: C, 63.35; H, 5.77.

Preparation of Toners

Kao C polymer, a commercial polyester binder available from Kao Corporation, was heated and melted on a 4-inch two roll melt-compounding mill. One of the rolls was heated and controlled to a temperature of 120° C., while the other roll was cooled with chilled water. A weighed amount of the charge control agent (CCA) was then compounded into the melt. An example batch formula would be 25 g of polyester and 0.5 g of CCA, giving a product with 2 part CCA per 100 parts of polymer. The melt was compounded for 15 minutes, peeled from the mill and cooled. The melt was coarse ground in a Thomas-Wiley laboratory mechanical mill using a 2 mm screen. The resulting material was fine ground in a Trost TX air jet mill at a pressure of 70 psi and a feed rate of 1 g/hr. The ground toner has a mean volume average particle size of approximately 8.5 $\mu$m. Following the above procedure, clear polyester toners containing only charge control agent were made.

Preparation of Developers

Developers comprising a mixture of toner and carrier particles were prepared for each charge agent evaluated. The carrier particles were polysiloxane coated strontium ferrite (obtained from Powdertech), a carrier type that is described in U.S. Pat. No. 4,478,925, the disclosure of which is incorporated herein by reference, Developers using this carrier type were formulated at 8% toner concentration, 0.32 g of toner being added to 3.68 g of carrier.

Testing of Developers

The developers prepared as described above were evaluated with respect to their Q/m and throw-off characteristics according to procedures described below. The toner compositions included in the developer formulations were all prepared using 25 grams of Kao C binder polymer and 0.25–0.75 grams of CCA. Test results are summarized in Table II.

MECCA Method of Charge Measurement

The previously mentioned U.S. Pat. No. 5,405,727 describes the analytical test method for measuring the toner charge/mass ratio of developers made with coated strontium ferrite carrier particles. Toner charge/mass (Q/m) was measured in microcoulombs per gram of toner ($\mu$C/gm) in a MECCA device. To measure the Q/m, a 100-mg sample of the charged developer was placed in the MECCA apparatus, and the charge to mass of the transferred toner was measured. This involves placing the 100 mg sample of the charged developer in a sample dish situated between a pair of circular parallel plates and subjecting it simultaneously for 30 seconds to a 60 Hz magnetic field and an electric field of about 200 volts/cm between the plates. The toner is thus separated from the carrier and is attracted to and collected on the top plate having polarity opposite to the toner charge. The total toner charge is measured by an electrometer connected to the plate, and that value is divided by the weight of the toner on the plate to yield the charge per mass of the toner (Q/m).

Measurement of Toner Charge and Toner Admix Dust

Toner charge was measured by vigorously exercising the developer mix to generate a triboelectrical charge, sampling the developer mix, and then measuring the toner charge with the MECCA charge measurement device.

"Admix" Toner Dust Measurement

The propensity of developers to form low charging toner dust was measured using an "admix" dust test following the procedure described in U.S. Pat. No. 5,405,727. Admix dust values were determined by lightly mixing 50% fresh toner (0.16 g) with the remaining developer to provide a final toner concentration of about 16%, followed by 30 second exercise on the wrist action shaker. This developer was then placed on a roll containing a rotating magnetic core, similar to a magnetic brush for electrostatic development. A weighing paper was placed inside the metal sleeve and the sleeve was placed over the brush and the end-piece was attached. The electrical connections were checked to ensure that the core was grounded. The electrometer was zeroed and the throw-off device was operated at 2000 rpm for 1 minute. The electrometer charge of the dust and the amount of dust collected on the weighing paper were measured and reported as the admix dust value (milligrams of dust).

One Hour Strip and Rebuild Test

Two 4 g batches of developers at 8% toner concentration were prepared by weighing and mixing 0.32 g toner and 3.68 g carrier (FCX4947) in two separate 4 dram PE plastic vials (Vial #1 and Vial #2). The vials were capped and placed in a Wrist-Shaker. The vials were vigorously shaken at about 2 Hertz and overall amplitude of about 11 cm for 2 minutes to triboelectrically charge the developer. The measured Q/m results are shown in Table II in the column captioned "Q/m, μC/g, 2'WS."

A Q/m measurement on 0.1 g developer from Vial #1 was run using the described MECCA apparatus. Conditions for the MECCA test procedure were: 0.1 g developer, 30 sec, 2000 V, negative polarity. The developer in Vial #1 was subsequently exercised for 10 minutes on a "bottle brush" device, which consists of a cylindrical roll having a magnetic core rotating at 2000 revolutions per minute. The magnetic core has 12 magnetic poles arranged around its periphery in an alternating north-south fashion to approximate the unreplenished aging of the developer in the electrostatographic development process. The Q/m measurement results are shown in Table II in the column captioned "Q/m, μC/g, 10'BB."

After this additional 10 minutes exercising, the toner charge was measured on the MECCA apparatus. An "Admix-dust" measurement was run on this developer to estimate the amount of admix dust. The results of this measurement are shown in the column in Table II captioned "TO mg/g, 10'BB."

Vial #2 was subsequently placed on the bottle brush device for 60 minutes. After this additional 60 minutes exercising, the toner charge was measured on the MECCA apparatus, the results being summarized in Table II in the column captioned "Q/m, μC/g, 60'BB."

The developer from vial #2 was subsequently stripped of the toner and rebuilt with fresh toner at 8% toner concentration in Vial #3. The developer was mixed using a spatula, and the capped Vial #3 was placed in the Wrist-Shaker and vigorously shaken at about 2 Hertz and overall amplitude of about 11 cm for 2 minutes to triboelectrically charge the developer. The Q/m measurements are shown in Table II in the asterisked column captioned "Q/m, μC/g, 2'WS."

A 2-minute rebuilt Q/m measurement on 0.1 g developer from Vial #3 was run using the MECCA apparatus. The test conditions were: 0.1 g developer, 30 sec, 2000 V, negative polarity. The developer in Vial #3 was subsequently exercised on the bottle brush device for 10 minutes. After this additional 10 minutes exercising, the 10-minute rebuilt toner charge was measured on the MECCA apparatus the results being shown in Table II in the asterisked column captioned "Q/m, μC/g, 10'BB." A 10-minute rebuilt "Admix-dust" measurement was run on this developer to estimate the amount of admix dust; the results of the measurements are in the asterisked column captioned "TO mg/g, 10'BB."

From the tests results presented in Table II, it can be seen that most of the developers showed a very high initial Q/m from the 2-minute Wrist Shaker treatment. This reflects the rapid charging ability of these toners, a highly desirable feature. In the evaluation of 10-minute Q/m and 10-minute admix throw-off on a rebuilt developer (subsequent to aging for 1 hour on the bottle brush), also shown in Table II, all combinations of X and Y substituents generally exhibit low Q/m values in addition to remarkably low admix dust values.

The invention has been described in detail for the purpose of illustration, but it is understood that such detail is solely for that purpose, and variations can be made therein by those skilled in the art without departing from the spirit and scope of the invention, which is defined by the claims that follow.

TABLE I

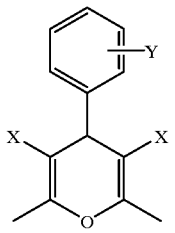

4-Phenyl-4-H-Pyrans

| Charge Control Agent | X | Y | Yield, % | mp, ° C. | TGA, ° C. | Color |
|---|---|---|---|---|---|---|
| CCA-1 | CO2CH3 | 4-Cl | 18.6 | 86-7 | | white |
| CCA-2 | CO2CH3 | H | 50.4 | 62.5 | | yellow |
| CCA-3 | CO2CH3 | 4-CH3 | 14.5 | 103–5 | | cream |
| CCA-4 | CO2CH3 | 4- 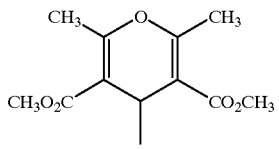 | 35.3 | 197–9 | | cream |
| CCA-5 | CO2CH2CH3 | 4-CH3 | 13.1 | 79–84 | 179.2 | off-white |
| CCA-6 | CO2CH2CH3 | 4-CH2CH3 | 36.8 | 63–5 | 193.2 | lt yellow |
| CCA-7 | CO2CH2CH3 | 4-OCH3 | 36.7 | 72–8 | 213.1 | lt orange |
| CCA-8 | CO2CH2CH3 | H | 48.4 | 71–4 | 179.3 | off-white |

TABLE I-continued

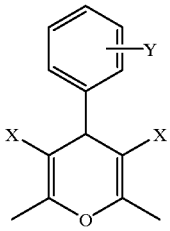

4-Phenyl-4-H-Pyrans

| Charge Control Agent | X | Y | Yield, % | mp, ° C. | TGA, ° C. | Color |
|---|---|---|---|---|---|---|
| CCA-9 | CO2CH2CH3 | 4-Cl | 49.8 | 63–6 | 191.6 | lt yellow |
| CCA-10 | CO2CH2CH3 | 4- 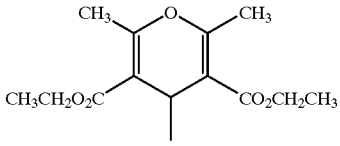 | 42.9 | 147–8 | 248.8 | lt yellow |
| CCA-11 | COCH3 | 4-CH3 | 23.8 | 63–73 | 187.4 | orange |
| CCA-12 | COCH3 | H | 21.5 | 83–5 | 173.5 | lt orange |
| CCA-13 | CONHC6H5 | H | 32.7 | 146–53 | 271.2 | off-white |
| CCA-14 | CONHC6H5 | 4-CH3 | 50.2 | 189–92 | 275.5 | off-white |

TABLE II

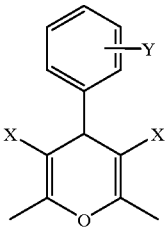

| Sample | Charge Agent | (g) | X | Y | O/m, μC/g 2'WS | O/m μC/g 10'BB |
|---|---|---|---|---|---|---|
| 1 | CCA-1 | 0.25 | CO2CH3 | 4-Cl | −63.3 | −40 |
| 2 | CCA-1 | 0.5 | CO2CH3 | 4-Cl | −61.4 | −44.2 |
| 3 | CCA-1 | 0.75 | CO2CH3 | 4-Cl | −69.6 | −44.7 |
| 4 | CCA-2 | 0.5 | CO2CH3 | H | —57.9 | −44.2 |
| 5 | CCA-2 | 0.75 | CO2CH3 | H | −58.1 | −45.1 |
| 6 | CCA-3 | 0.5 | CO2CH3 | 4-CH3 | −66.2 | −41.8 |
| 7 | CCA-3 | 0.75 | CO2CH3 | 4-CH3 | −62.3 | −41.6 |
| 8 | CCA-4 | 0.5 | CO2CH3 | 4- 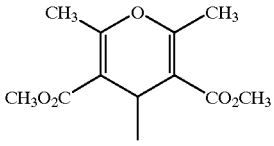 | −49.3 | −36.1 |
| 9 | CCA-4 | 0.5 | CO2CH3 | 4- 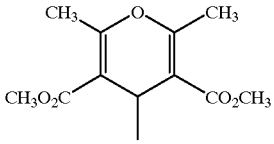 | −48.9 | −38.1 |
| 10 | CCA-5 | 0.50 | CO2CH2CH3 | 4-CH3 | −50.4 | −46.3 |
| 11 | CCA-5 | 0.75 | CO2CH2CH3 | 4-CH3 | −47.7 | −48.2 |
| 12 | CCA-6 | 0.50 | CO2CH2CH3 | 4-CH2CH3 | −63.9 | −47.3 |
| 13 | CCA-6 | 0.75 | CO2CH2CH3 | 4-CH2CH3 | −66.7 | −52.9 |

TABLE II-continued

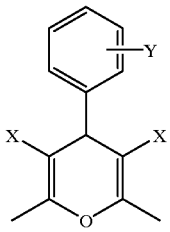

| | | | | | | | |
|---|---|---|---|---|---|---|---|
| 14 | CCA-7 | 0.50 | CO2CH2CH3 | 4-OCH3 | | −63.7 | −47.2 |
| 15 | CCA-7 | 0.75 | CO2CH2CH3 | 4-OCH3 | | −58.7 | −48.0 |
| 16 | CCA-8 | 0.50 | CO2CH2CH3 | H | | −57.7 | −43.9 |
| 17 | CCA-8 | 0.75 | CO2CH2CH3 | H | | −58.7 | −45.6 |
| 18 | CCA-9 | 0.50 | CO2CH2CH3 | 4-Cl | | −55.7 | −41.3 |
| 19 | CCA-9 | 0.75 | CO2CH2CH3 | 4-Cl | | −55.8 | −46.4 |
| 20 | CCA-10 | 0.50 | CO2CH2CH3 | 4- | 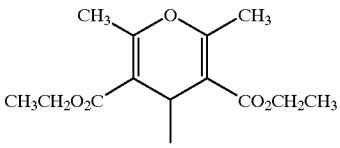 | −58.7 | −48.0 |
| 21 | CCA-10 | 0.75 | CO2CH2CH3 | 4- | 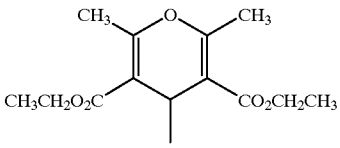 | −55.6 | −41.9 |
| 22 | CCA-11 | 0.50 | COCH3 | 4-CH3 | | −54.9 | −40.0 |
| 23 | CCA-11 | 0.75 | COCH3 | 4-CH3 | | −52.6 | −41.1 |
| 24 | CCA-12 | 0.50 | COCH3 | H | | −56.6 | −44.6 |
| 25 | CCA-12 | 0.75 | COCH3 | H | | −56.8 | −44.5 |
| 26 | CCA-13 | 0.50 | CONHC6H5 | H | | −50.3 | −36.7 |
| 27 | CCA-13 | 0.75 | CONHC6H5 | H | | −51.4 | −42.3 |
| 28 | CCA-14 | 0.50 | CONHC6H5 | 4-CH3 | | −48.4 | −42.2 |
| 29 | CCA-14 | 0.75 | CONHC6H5 | 4-CH3 | | −50.2 | −37.9 |

| Sample | O/m, μC/g 60'BB | TO mg 10'BB | O/m, μC/g 2'WS | O/m, μC/g 10'BB | TO mg 10'BB |
|---|---|---|---|---|---|
| 1 | −47.9 | 5.7 | −18 | −30 | 5.9 |
| 2 | −52.8 | 4.6 | −20.7 | −34.5 | 6 |
| 3 | −54.4 | 4.3 | −24.9 | −39.7 | 4.7 |
| 4 | −52.8 | 3 | −17.1 | −33.9 | 2.6 |
| 5 | −54.8 | 4.7 | −25.1 | −40.6 | 4.6 |
| 6 | −55.6 | 1.3 | −31.5 | −38.8 | 6.9 |
| 7 | −56.6 | 3.4 | −28.9 | −36 | 9.1 |
| 8 | −51 | 3.1 | −21.8 | −29.2 | 4.2 |
| 9 | −52.5 | −2 | −21.4 | −28.1 | 3.1 |
| 10 | −55.6 | 2.7 | −31.9 | −42.0 | 2.4 |
| 11 | −56.8 | 1.8 | −37.4 | −43.4 | 1.5 |
| 12 | −62.9 | 14.5 | −29.5 | −47.5 | 15.9 |
| 13 | −69.1 | 11.4 | −33.0 | −50.8 | 14.5 |
| 14 | −58.1 | 13.5 | −27.2 | −44.2 | 9.7 |
| 15 | −63.9 | 9.5 | −29.2 | −46.1 | 41.3 |
| 16 | −49.5 | 1.8 | −22.5 | −36.9 | 2.7 |
| 17 | −50.5 | 3.5 | −30.2 | −39.8 | 2.5 |
| 18 | −52.5 | 11.3 | −25.9 | −35.4 | 13.3 |
| 19 | −57.1 | 6.6 | −30.6 | −42.3 | 10.6 |
| 20 | −63.9 | 9.5 | −29.2 | −46.1 | 41.3 |
| 21 | −52.7 | 11.3 | −25.2 | −29.0 | 36.1 |
| 22 | −53.3 | 2.5 | −30.6 | −36.6 | 1.2 |
| 23 | −54.4 | 1.0 | −31.5 | −41.1 | 3.0 |
| 24 | −52.0 | 2.4 | −25.8 | −35.1 | 5.3 |
| 25 | −50.7 | 1.7 | −23.0 | −38.0 | 2.5 |
| 26 | −45.5 | 12.7 | −24.5 | −34.7 | 14.3 |
| 27 | −44.8 | 9.7 | −21.4 | −34.7 | 14.1 |
| 28 | −46.2 | 9.1 | −23.5 | −34.8 | 15.4 |
| 29 | −42.7 | 7.3 | −22.3 | −30.1 | 15.7 |

What is claimed is:

1. An electrostatographic toner composition comprising a thermoplastic polymeric binder and a charge control agent selected from the group consisting of 4H-pyran compounds represented by the following general structure:

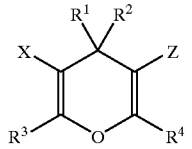

where $R^1$ and $R^2$ are the same or different, each representing H or an alkyl, an aryl or a heterocyclic group, or $R^1$ and $R^2$ taken together may form a saturated hydrocarbon ring;

$R^3$ and $R^4$ each represent an alkyl or an aryl group;

X and Z are the same or different, each representing a cyano substituent, or an alkanoyl, an aroyl, an alkoxycarbonyl, an aryloxycarbonyl, an arylaminocarbonyl, or an alkylaminocarbonyl group.

2. The toner composition of claim 1 wherein $R^1$ represents H or a phenyl group and $R^2$ represents H.

3. The toner composition of claim 2 wherein $R^1$ represents a phenyl, a 4-chlorophenyl, a 4-methylphenyl, a 4-ethylphenyl, a 4-methoxyphenyl, or a

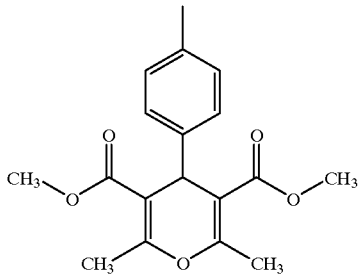

substituent.

4. The toner composition of claim 1 wherein X and Z each represent an alkoxycarbonyl, an alkanoyl, or an arylaminocarbonyl group.

5. The toner composition of claim 4 wherein X represents an alkoxycarbonyl group and Z represents an arylaminocarbonyl group.

6. The toner composition of claim 5 wherein $R^3$ and $R^4$ each represents an alkyl group.

7. The toner composition of claim 4 wherein X and Z are the same and each represent an ethoxycarbonyl, a methoxycarbonyl, an acetyl, or a phenylaminocarbonyl substituent.

8. The toner composition of claim 1 wherein $R^3$ and $R^4$ each represents an alkyl group containing up to about 8 carbon atoms.

9. The toner composition of claim 8 wherein $R^3$ and $R^4$ are the same and each represents a methyl substituent.

10. The toner composition of claim 1 wherein the charge control agent is selected from the group of charge control agents CCA-1, CCA-2, CCA-3, CCA-4, CCA-5, CCA-6, CCA-7, CCA-8, CCA-9, CCA-10, CCA-11, CCA-12, CCA-13, and CCA-14, said charge control agents comprising 4-phenyl-4-H-pyran compounds having structural formulas as shown in Table I.

11. The toner composition of claim 1 wherein said polymeric binder is a polyester or a styrene-acrylic copolymer.

12. The toner composition of claim 11 wherein said polymeric binder is a polyester.

13. The toner composition of claim 1 comprising about 0.5 part to 10 parts of said charge control agent per 100 parts of said polymeric binder.

14. The toner composition of claim 13 comprising about 1 part to 5 parts of said charge control agent per 100 parts of said polymeric binder.

15. The toner composition of claim 1 further comprising a colorant.

16. An electrostatographic developer comprising carrier particles and particles of a toner composition, said toner composition comprising a thermoplastic polymeric binder and a charge control agent selected from the group consisting of 4H-pyran compounds represented by the following general structure:

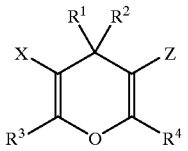

where $R^1$ and $R^2$ are the same or different, each representing H or an alkyl, an aryl or a heterocylic group, or $R^1$ and $R^2$ taken together may form a saturated hydrocarbon ring;

$R^3$ and $R^4$ each represent an alkyl or an aryl group;

X and Z are the same or different, each representing a cyano substituent, or an alkanoyl, an aroyl, an alkoxycarbonyl, an aryloxycarbonyl, an arylaminocarbonyl, or an alkylaminocarbonyl group.

17. The developer of claim 16 wherein $R^1$ represents H or a phenyl group and $R^2$ represents H.

18. The developer of claim 17 wherein $R^1$ represents a phenyl, a 4-chlorophenyl, a 4-methylphenyl, a 4-ethylphenyl, a 4-methoxyphenyl, or a

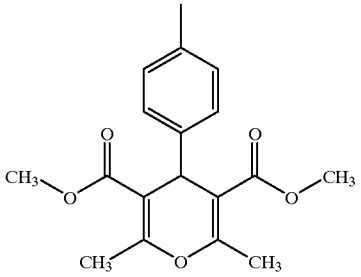

substituent.

19. The developer of claim 16 wherein X and Z each represent an alkoxycarbonyl, an alkanoyl, or an arylaminocarbonyl group.

20. The developer of claim 19 wherein X and Z are the same and each represent an ethoxycarbonyl, a methoxycarbonyl, an acetyl, or a phenylaminocarbonyl substituent.

21. The developer of claim 16 wherein $R^3$ and $R^4$ are the same and each represents a methyl substituent.

22. The developer of claim 16 wherein the charge control agent is selected from the group of charge control agents CCA-1, CCA-2, CCA-3, CCA-4, CCA-5, CCA-6, CCA-7, CCA-8, CCA-9, CCA-10, CCA-11, CCA-12, CCA-13, and CCA-14, said charge control agents comprising 4-phenyl-4-H-pyran compounds having structural formulas as shown in Table I.

23. The developer of claim 16 wherein said polymeric binder is a polyester or a styrene-acrylic copolymer.

24. The developer of claim 16 wherein said carrier particles comprise ferrite particles.

25. The developer of claim 16 comprising about 80 to 99 weight percent of said carrier particles and about 20 to 1 weight percent of said toner composition particles.

26. The developer of claim 16 wherein said carrier particles have a particle size of about 5 $\mu$m to 1200 $\mu$m, and said toner composition particles have a particle size of about 0.1 $\mu$m to 100 $\mu$m.

27. The developer of claim 26 wherein said carrier particles have a particle size of about 20 $\mu$m to 200 $\mu$m, and said toner composition particles have a particle size of about 4 $\mu$m to 30 $\mu$m.

* * * * *